US011248346B2

(12) United States Patent
Lee

(10) Patent No.: US 11,248,346 B2
(45) Date of Patent: Feb. 15, 2022

(54) DISSOLVED AIR DE-BONDING OF A TISSUE SHEET

(71) Applicant: GPCP IP Holdings LLC, Atlanta, GA (US)

(72) Inventor: Jeffrey A. Lee, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 17/025,028

(22) Filed: Sep. 18, 2020

(65) Prior Publication Data

US 2021/0140117 A1 May 13, 2021

Related U.S. Application Data

(62) Division of application No. 16/674,336, filed on Nov. 5, 2019, which is a division of application No. (Continued)

(51) Int. Cl.

| | |
|---|---|
| ***D21H 27/00*** | (2006.01) |
| ***D21H 21/22*** | (2006.01) |
| ***D21F 11/14*** | (2006.01) |
| ***D21F 11/00*** | (2006.01) |
| ***D21H 11/04*** | (2006.01) |
| ***D21H 11/06*** | (2006.01) |
| ***D21H 11/08*** | (2006.01) |
| ***D21H 11/14*** | (2006.01) |

(52) U.S. Cl.

CPC ..... *D21H 27/005* (2013.01); *D21F 11/002* (2013.01); *D21F 11/14* (2013.01); *D21H 11/04* (2013.01); *D21H 11/06* (2013.01); *D21H 11/08* (2013.01); *D21H 11/14* (2013.01); *D21H 21/22* (2013.01); *D21H 27/002* (2013.01)

(58) Field of Classification Search

CPC .... D21H 27/005; D21H 27/002; D21H 11/04; D21H 11/06; D21H 11/08; D21H 11/14; D21H 21/56; D21H 25/04; D21H 21/00; D21H 21/22; D21F 11/14; D21F 11/002

See application file for complete search history.

(56) References Cited

U.S. PATENT DOCUMENTS 1,597,010 A * 8/1926 Karlbubla ..... B27K 3/0221 427/297
2,481,959 A 9/1949 Wahlin
(Continued)

FOREIGN PATENT DOCUMENTS

CA 3024127 A1 * 11/2017 ..... D21H 11/14
WO 2016049546 A1 3/2016

OTHER PUBLICATIONS

International Search Report dated Jul. 31, 2017, PCT Appl. No. PCT/US2017/032880, 10 pages.
(Continued)

*Primary Examiner* — Jose A Fortuna
(74) *Attorney, Agent, or Firm* — Laura L. Bozek

(57) ABSTRACT

Tissue papers and methods of making are disclosed herein. In one aspect, a tissue paper is substantially free of a chemical debonder and has a geometric mean tensile (GMT) in a range between about 500 and about 5,000 g/3 inches (g/3 in.) and a caliper in a range between about 50 and about 350 mils/8 sheets.

3 Claims, 13 Drawing Sheets

Related U.S. Application Data

15/589,463, filed on May 8, 2017, now Pat. No. 10,519,607.

(60) Provisional application No. 62/340,038, filed on May 23, 2016.

(56) References Cited

U.S. PATENT DOCUMENTS

| | | | | |
|---|---|---|---|---|
| 3,006,805 | A | 10/1961 | Waggoner | |
| 3,044,925 | A | 7/1962 | Berlyn | |
| 3,135,652 | A | 6/1964 | Smith | |
| 3,293,120 | A | 12/1966 | Harman, Jr. et al. | |
| 3,301,746 | A | 1/1967 | Sanford et al. | |
| 3,798,122 | A | 3/1974 | Appel | |
| 3,871,952 | A | 3/1975 | Robertson | |
| 3,880,705 | A | 4/1975 | Tilburg | |
| 4,443,299 | A | 4/1984 | Cheshire et al. | |
| 4,488,932 | A | 12/1984 | Eber et al. | |
| 4,543,156 | A | 9/1985 | Cheshire et al. | |
| 5,164,045 | A | 11/1992 | Awofeso et al. | |
| 5,227,023 | A | 7/1993 | Pounder et al. | |
| 5,308,384 | A | 5/1994 | Kapanen et al. | |
| 5,882,479 | A | 3/1999 | Oriaran et al. | |
| 6,103,060 | A | 8/2000 | Munerelle et al. | |
| 6,136,153 | A | 10/2000 | Rokman et al. | |
| 6,277,606 | B1 | 8/2001 | Wigler et al. | |
| 6,287,417 | B1 | 9/2001 | Bhat | |
| 6,355,142 | B1 | 3/2002 | Ahrens | |
| 6,368,454 | B1 | 4/2002 | Dwiggins et al. | |
| 6,413,368 | B1 | 7/2002 | Dwiggins et al. | |
| 6,416,624 | B1 | 7/2002 | Nielsen et al. | |
| 6,500,302 | B2 | 12/2002 | Dwiggins et al. | |
| 6,503,372 | B1 | 1/2003 | Rokman et al. | |
| 7,399,378 | B2 | 7/2008 | Edwards et al. | |
| 7,651,589 | B2 | 1/2010 | Murray et al. | |
| 7,850,820 | B2 * | 12/2010 | Scherb | D21F 11/14 162/117 |
| 7,972,476 | B2 * | 7/2011 | Scherb | D21H 27/002 162/147 |
| 8,303,773 | B2 * | 11/2012 | Scherb | D21F 3/0281 162/202 |
| 10,519,607 | B2 * | 12/2019 | Lee | D21H 21/56 |
| 10,676,871 | B2 | 6/2020 | Dwiggins | |
| 2002/0066544 | A1 | 6/2002 | Dwiggins et al. | |
| 2002/0079073 | A1 | 6/2002 | Wilhelm | |
| 2002/0148584 | A1 | 10/2002 | Edwards et al. | |
| 2002/0195213 | A1 | 12/2002 | Izumi et al. | |
| 2003/0131960 | A1 | 7/2003 | McConnell et al. | |
| 2004/0118539 | A1 | 6/2004 | Sundaram et al. | |
| 2005/0133175 | A1 | 6/2005 | Hada et al. | |
| 2006/0243408 | A1 | 11/2006 | Blodgett et al. | |
| 2006/0266487 | A1 * | 11/2006 | Scherb | D21F 11/145 162/158 |
| 2007/0029061 | A1 * | 2/2007 | Scherb | D21F 3/10 162/289 |
| 2007/0062657 | A1 * | 3/2007 | Scherb | D21F 11/14 162/117 |
| 2007/0119558 | A1 * | 5/2007 | Scherb | D21H 27/002 162/109 |
| 2007/0151681 | A1 | 7/2007 | Doelle | |
| 2009/0194244 | A1 | 8/2009 | Harper et al. | |
| 2009/0205794 | A1 * | 8/2009 | Scherb | D21F 5/182 162/28 |
| 2010/0186913 | A1 | 7/2010 | Super et al. | |
| 2011/0290439 | A1 * | 12/2011 | Scherb | D21F 11/145 162/203 |
| 2014/0284013 | A1 | 9/2014 | Hermans et al. | |
| 2015/0184342 | A1 | 7/2015 | Saas et al. | |
| 2015/0330029 | A1 | 11/2015 | Ramaratnam et al. | |
| 2015/0330030 | A1 | 11/2015 | Dwiggins | |
| 2016/0090693 | A1 | 3/2016 | Eagles et al. | |
| 2016/0145809 | A1 | 5/2016 | Hermans et al. | |
| 2017/0101739 | A1 | 4/2017 | Shannon et al. | |
| 2017/0335521 | A1 * | 11/2017 | Lee | D21H 27/002 |
| 2018/0056621 | A1 | 3/2018 | Slayton et al. | |
| 2018/0104928 | A1 | 4/2018 | Dwiggins | |
| 2018/0135249 | A1 | 5/2018 | Shannon et al. | |
| 2018/0266055 | A1 | 9/2018 | Dwiggins | |
| 2020/0040529 | A1 | 2/2020 | Rouse et al. | |
| 2020/0080265 | A1 * | 3/2020 | Lee | D21H 11/06 |
| 2020/0298525 | A1 | 9/2020 | Dwiggins | |
| 2021/0140117 | A1 * | 5/2021 | Lee | D21H 11/06 |

OTHER PUBLICATIONS

Page, D.H., "A theory for the tensile strength of paper," Technical Information Center, Pulp and Paper Research, Institute of Canada, PAPRICAN, PPR-7, Jul. 1968, pp. 1-34.

Extended European Search Report dated Jan. 31, 2020 in GPW0027EP.

Tejado, Alvaro et al., "Why does paper get stronger as it dries?," materialstoday, Sep. 2010, vol. 13, No. 9, pp. 1-4.

Turnbull, R. B., Jr., "Deaerator Design for Paper Machines," Pulp and Paper Manufacture, vol. 6, Stock Preparation, TAPPI 1992, pp. 1-11.

Written Opinion dated Jul. 31, 2017, PCT Application No. PCT/US2017/032880, 6 pages.

* cited by examiner

DISSOLVED AIR DE-BONDING OF A TISSUE SHEET

CROSS-REFERENCE TO RELATED APPLICATIONS

This application is a divisional of U.S. patent application Ser. No. 16/674,336, filed Nov. 5, 2019, which is a divisional of U.S. patent application Ser. No. 15/589,463, filed May 8, 2017, now U.S. Pat. No. 10,519,607, which is based on U.S. Provisional Patent Application No. 62/340,038, filed May 23, 2016, all applications are hereby incorporated by reference in their entirety.

TECHNICAL FIELD

The present invention is directed generally to a method for making tissue paper. More specifically, the present invention is related a method for making bulky tissue paper.

BACKGROUND OF THE INVENTION

Softness is a desired property in tissues. Perceived softness correlates with properties of weak strength, enhanced bulk, and surface smoothness or texture. Methods of making soft tissue and towel are known and include, for example, Yankee creping, through drying, fabric creping, shoe pressing, and others. Some effects of such processes are to inhibit the formation of inter-fiber bonds, such as hydrogen bonds, as the sheet is dewatered, as well as to break up the bonds that have formed in the sheet as a result of the machine design.

Although the resulting tensile strength of a paper sheet after formation may not be fully understood, a number of theories provide reasonable models. According to one model (described in Page, D. H., "A Theory for the Tensile Strength of Paper," PAPRICAN, PPR-7, July 1968), the tensile strength of a given population of fibers and a given paper machine design can be explained by the relative bonded area (RBA) of the fibers in the sheet. The RBA is a function of the number of inter-fiber bonds that form during the formation, handling, pressing and drying of the paper sheet. The strength of a wet web of cellulose fibers is initially low. As water is removed from the web, water molecules can form bridges between hydroxyl groups in adjacent fibers. As more water is removed, capillary forces ("Campbell Effect" forces) can draw the fibers close enough so that a hydrogen bond can form between fibers, giving the web dry strength. In another model (described in Tejado, A. and van de Ven, T. G. M., "Why Does Paper Get Stronger as it Dries?" Materials Today, September 2010, Volume 13 Number 9), surface tension and wetting forces also contribute to wet strength and formation of hydrogen bonds as the paper web dries. Similar forces occur in the hollow lumen of cellulosic fibers, which can cause them to collapse as water is removed and become flat and ribbon-like.

Other aspects of paper manufacturing can affect tensile. For example, pressing increases the tensile strength of a wet paper web by both removing water from the matrix and by bringing the fibers closer together so that fiber to fiber bonding is promoted. A papermaking process is described in U.S. Pat. No. 3,301,746 to Sanford et al., which eliminates wet pressing and thus aims to avoid fiber-to-fiber bonding and increase the softness, bulk and absorbency of a tissue sheet.

Another method used to increase softness is addition of chemical debonders to the cellulosic fibers during production. Chemical debonders inhibit the ability of fibers to form hydrogen bonds and therefore results in a reduced tensile strength.

Conventional wet pressed machines (CWP) utilize a pressing step to increase the solids content of the sheet as it is transferred to the Yankee drying cylinder. The bonds generated in the sheet by the pressing step are then disrupted by a combination of chemical debonder addition and creping the sheet off the Yankee dryer.

In addition, many modern sheet machines use "through air drying" (TAD) to reduce strength and increase bulk. TAD minimizes hydrogen bond formation in the sheet by removing water from an un-pressed wet web utilizing combinations of vacuum, steam and hot air and provides a reduced basis weight at a given bulk level. TAD provides a fiber cost savings over a CWP machine but requires a higher energy cost to thermally remove the high levels of water in the unpressed sheet.

Fabric creping (FC) processes increase the bulk and softness compared to CWP and provides lower energy costs than TAD. Chemical debonders may be used to increase the softness of tissues made by CWP and FC methods. However, chemical debonders may not be able to overcome the advantage of higher bulk at a given basis weight of TAD.

Although chemical debonders and TAD technology provide desirable tissue papers, these processes are expensive. Further, tissue paper production with TAD technology has an inherently high operating cost because of high energy input requirements.

The potentially detrimental impacts of air in the wet zones of a papermaking process are known. For example, as described in Turnbull, R. B., Jr., "Deaerator Design for Paper Machines," Pulp and Paper Manufacture, Volume 6, Stock Preparation, TAPPI 1992, air in the formation zone and wet areas of a papermachine can result in poor formation, poor drainage, and runnability issues. Therefore, various approaches have been developed to mitigate air in the wet zones of the papermaking processes. One such approach, described in U.S. Pat. No. 5,308,384 to Kapanen et al., attempts to improve papermaking stock quality by initially de-aerating the stock.

Based on the foregoing, there still exists a need for a method for making a bulky, low strength tissue paper at reduced operating costs, compared to conventional methods, with low levels of chemical debonders or without chemical debonders. Accordingly, it is to solving this and other needs the present invention is directed.

SUMMARY OF THE INVENTION

According to one aspect, a tissue paper is substantially free of a chemical debonder and has a geometric mean tensile (GMT) in a range between about 500 and about 5,000 g/3 inches (g/3 in.) and a caliper in a range between about 50 and about 350 mils/8 sheets.

According to another aspect, a method of making a tissue paper substantially free of a chemical debonder and having a GMT in a range between about 500 and about 5,000 g/3 in. and a caliper in a range between about 50 and about 350 mils/8 sheets includes mixing an aqueous solution and a fiber slurry comprising cellulosic fibers under a super-atmospheric pressure in a contained environment in the presence of a water-soluble gas to form a dilute dissolved gas-impregnated fiber slurry comprising dissolved gas-impregnated fibers; discharging the dilute dissolved gas-impregnated fiber slurry from the contained environment directly onto a foraminous support at a lower pressure to form a nascent web, the lower pressure being a pressure less than the super-atmospheric pressure; and drying the nascent web to expand, separate, or both expand and separate the dissolved gas-impregnated fibers to form the tissue paper.

According to another aspect, a method of making a tissue paper substantially free of a chemical debonder and having a GMT in a range between about 500 and about 2,500 g/3 in. and a caliper of at least about 50 mils/8 sheets includes exposing an aqueous solution to a water-soluble gas under a super-atmospheric pressure in a contained environment to form a dissolved gas-impregnated solution; mixing the dissolved gas-impregnated solution with a fiber slurry comprising cellulosic fibers in the contained environment to form a dilute dissolved dissolved gas-impregnated fiber slurry comprising dissolved gas-impregnated fibers; discharging the dilute dissolved gas-impregnated fiber slurry from the contained environment directly onto a foraminous support at atmospheric pressure to form a nascent web; and drying the nascent web to expand, separate, or both expand and separate the dissolved gas-impregnated fibers to form the tissue paper.

Yet, according to another aspect, a gas-impregnated tissue paper substantially free of a chemical debonder has a percent increase in slope of velocity/pressure (($feet^3$/min/$feet^2$)/inches water column) as a function of $1/P^{0.5}$ of at least 22% compared to a like non-gas-impregnated tissue paper; wherein P is pressure from about 8 inches water column to about 20 inches water column.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the present invention. It is important, therefore, that the claims be regarded as including such equivalent constructions insofar as they do not depart from the spirit and scope of the present invention.

Other advantages and capabilities of the invention will become apparent from the following description taken in conjunction with the examples showing aspects of the present invention.

BRIEF DESCRIPTION OF THE DRAWINGS

The invention will be better understood and the above object as well as objects other than those set forth above will become apparent when consideration is given to the following detailed description thereof. Such description makes reference to the annexed drawings wherein.

DETAILED DESCRIPTION OF THE INVENTION

Figure 1:
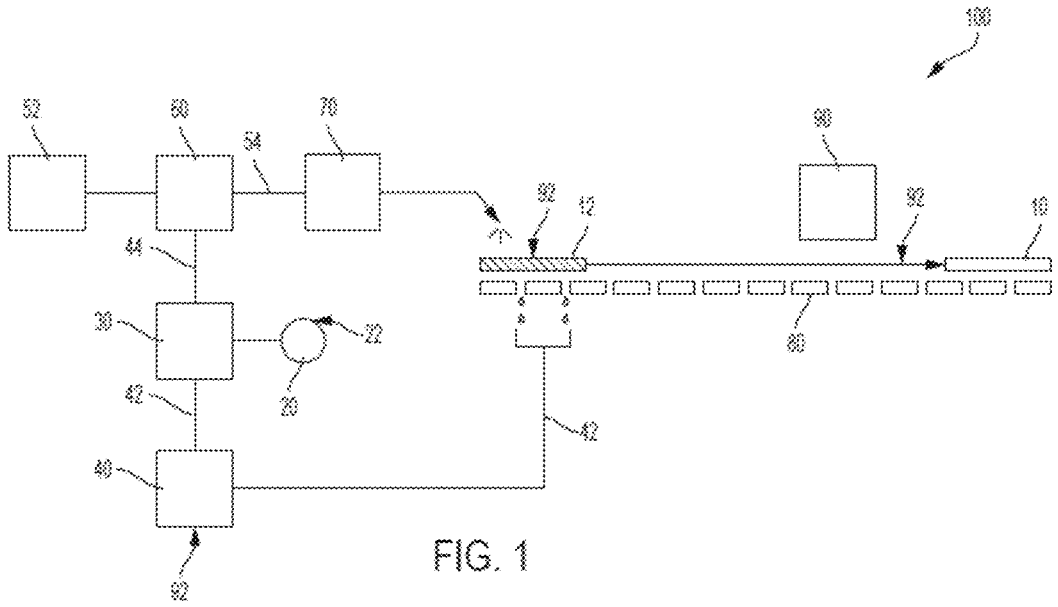
FIG. 1 is a general schematic of a method for making a tissue paper in accordance with an aspect of the present invention.

The present invention is directed to bulky tissue papers that are substantially free of a chemical debonder. In accordance with an aspect of the present invention, a tissue paper is substantially free of a chemical debonder and has a geometric mean tensile (GMT) in a range between about 500 and about 5,000 g/3 inches (g/3 in.) and a caliper in a range between about 50 and about 350 mils/8 sheet. In another aspect, the tissue paper is void of a chemical debonder. Yet, in another aspect, the tissue paper has less than 4 lb/ton chemical debonder, or less than 2 lb/ton chemical debonder. Some benefits of tissues that are substantially free of chemical debonders include (1) softness increase through tensile reduction and (2) reduced drying energy.

In one aspect, a method of making a tissue paper substantially free of a chemical debonder and having a GMT in a range between about 500 and about 5,000 g/3 in. and a caliper in a range between about 50 and about 350 mils/8 sheets comprises mixing an aqueous solution and a fiber slurry under a super-atmospheric pressure in a contained environment in the presence of a water-soluble gas to form a dilute dissolved gas-impregnated fiber slurry. The fiber slurry comprises cellulosic fibers and the dilute dissolved gas-impregnated fiber slurry comprises dissolved gas-impregnated fibers. The dilute dissolved gas-impregnated fiber slurry is discharged from the contained environment directly onto a foraminous support at a lower pressure to form a nascent web. The lower pressure is atmospheric pressure in some aspects. The nascent web is dried to expand, separate, or both expand and separate the dissolved gas-impregnated fibers to form the tissue paper.

Without being bound by theory, it is believed that after formation of the nascent web, the dissolved gasses start forming bubbles at nucleation sites on the fibers. The bubbles grow and inhibit hydrogen bonding on the fiber surfaces and in the fiber lumen as the sheet is dried.

In one aspect, the dilute dissolved gas-impregnated fiber slurry is formed by first exposing the aqueous solution to the water-soluble gas under the super atmospheric pressure in the contained environment to form a dissolved gas-impregnated solution. Then, the dissolved gas-impregnated solution is mixed with the fiber slurry in the contained environment to form the dilute dissolved gas-impregnated fiber slurry. In another aspect, the dilute dissolved gas-impregnated fiber slurry is formed by exposing the fiber slurry to the water-soluble gas under the super-atmospheric pressure in the contained environment to form a dissolved gas-impregnated fiber slurry. Then, the dissolved gas-impregnated fiber slurry is mixed with the aqueous solution to form the dilute dissolved gas-impregnated fiber slurry. Yet, in another aspect, the dilute dissolved gas-impregnated fiber slurry is formed by first forming a dilute fiber slurry. Then, the dilute fiber slurry is exposed to the water-soluble gas under the super-atmospheric pressure in the contained environment to form the dilute dissolved gas-impregnated fiber slurry.

In another aspect, a method of making a tissue paper substantially free of a chemical debonder and having a GMT in a range between about 500 and about 2,500 g/3 and a bulk of at least about 50 mils/8 sheets comprises exposing an aqueous solution to a water-soluble gas under a super-atmospheric pressure in a contained environment to form a dissolved gas-impregnated solution. Then, the dissolved gas-impregnated solution is mixed with a fiber slurry comprising cellulosic fibers in the contained environment to form a dilute dissolved gas-impregnated fiber slurry comprising dissolved gas-impregnated fibers. The dilute dissolved gas-impregnated fiber slurry is discharged from the contained environment directly onto a foraminous support at atmospheric pressure to form a nascent web. The nascent web is dried to expand, separate, or both expand and separate the dissolved gas-impregnated fibers to form the tissue paper.

Terminology used herein is given its ordinary meaning consistent with the exemplary definitions set forth immediately below. "Mils" refers to thousandths of an inch; "mg" refers to milligrams, "$m^2$" refers to square meters, percent means weight percent (dry basis), "ton" means short ton (2,000 pounds), and so forth. Test specimens are prepared under standard Technical Association of the Pulp and Paper Industry (TAPPI) conditions. TAPPI test method T 205 was used for forming handsheets for physical tests of fiber pulp.

As used herein, the term "about" modifying the quantity of an ingredient, component, or reactant of the invention employed refers to variation in the numerical quantity that can occur, for example, through typical measuring and liquid handling procedures used for making concentrates or solutions in the real world. Furthermore, variation can occur from inadvertent error in measuring procedures, differences in the manufacture, source, or purity of the ingredients employed to make the compositions or carry out the methods, and the like. Whether or not modified by the term "about," the claims include equivalents to the quantities. In one aspect, the term "about" means within 10% of the reported numerical value. In another aspect, the term "about" means within 5% of the reported numerical value. Yet, in another aspect, the term "about" means within 9%, 8%, 7%, 6%, 4%, 3%, 2%, or 1% of the reported numerical value.

As used herein, the term "dissolved gas" refers to any gas that exists in a simple physical solution and is distinguished from a gas that has chemically reacted with water or components present in the water, or a colloidal dispersion of a gas. Dissolved gases exist as individual molecules or as molecules arranged in close proximity to one another to form micro gas bubbles having diameters less than or equal to 50 micrometers.

As used herein, the terms "entrained gas bubbles," "gas bubbles," and "macro gas bubbles" refer to a body of gas or gases with diameters greater than 50 micrometers.

As used herein, the term "substantially free of chemical debonder" means that the tissue paper has less than 4 pounds per ton (lb/ton), or less than 0.2 weight % (wt. %) of chemical debonder. In one aspect, substantially free of chemical debonder means less than 2 lb/ton, or less than or 0.1% wt. % chemical debonder. In another aspect, the tissue paper made in accordance with the present invention is void of chemical debonder. Yet, in another aspect, substantially free of chemical debonder means less than 4, 3.5, 3, 2, 2.5, 2, 1.5, 1, or 0.5 lb/ton of chemical debonder.

The terms "psi" and "PSI" as used herein refers to pounds of force per square inch, a unit of pressure. "PSI" is the pressure resulting from a pound of force applied to an area of one square inch. One atmosphere of pressure equates to approximately 14.7 psi. Unless otherwise indicated, pressure in units of psi is in pounds per square inch gauge (psig), which is relative to atmospheric pressure.

The term "consistency" as used herein refers to the percent solid in a composition comprising a solid in a liquid carrier. For example, the consistency of a fiber slurry weighing 100 grams and comprising 50 grams of fibers has a consistency of 50% weight.

The terms "basis weight", "BWT," "bwt," and so forth, as used herein, refers to the weight per unit area of a 3,000 square foot ream of product. The basis weight is measured using test procedure ASTM D 3776-96 or TAPPI Test Method T-220 and is reported in units of pounds/3,000 $feet^2$ or lb/3,000 $ft^2$.

Sheet "caliper" and or "bulk" refer to thickness of a tissue sheet. Caliper or bulk is measured in accordance with TAPPI Test Method T 580 pm-12. Caliper or bulk reported herein can be measured using 1, 4, or 8 sheet calipers as specified. The sheets are stacked, and the caliper measurements are taken at the central portion of the stack. The test samples are conditioned in an atmosphere of 23° ±1.0° C. (73.4°±1.8° F.) at 50% relative humidity for at least about 2 hours. Then the test samples are measured with a Thwing-Albert Model 89-II-JR or Progage Electronic Thickness Tester, with 2-in (50.8 mm) diameter anvils, 539±10 grams dead weight load, and 0.231 in./sec descent rate. For finished product testing, each sheet of product to be tested must have the same number of plies as the product when sold. Caliper units herein are reported as mils/sheet.

The term "machine direction" (MD), as used herein, is the direction of a material parallel to its forward direction during processing. The term "cross direction" (CD), is the direction of a material perpendicular to its machine direction. In reference to laboratory handsheets, the MD is determined by the pattern of the fabric used to make the handsheet and corresponds to the design MD of the fabric when installed on a paper machine.

The terms "tensile" and "tensile strength" as used herein, refers to the breaking force required to rupture strength of the tissue, or the force that the tissue can withstand before tearing. Tensile and normalized tensile measurements are reported in units of kilograms/15 millimeters or kg/15 mm.

The term "machine direction tensile," or "MD tensile," as used herein, is the breaking force in the machine direction necessary to rupture a three inch wide specimen. The term "cross direction tensile," or "CD tensile," as used herein is the breaking force in the cross direction necessary to rupture a one or three inch specimen. The units of MD and CD tensile are grams/3 inches, or g/3 in.

The term "geometric mean tensile," or "GMT," as used herein means the square root of the product of the CD and MD tensile. GMT measurements normalize for the change in tensile in the CD and MD directions. GMT tensile is measured in accordance with TAPPI Test Method T 494.

CD tensile and MD tensile measurements are performed on dry sheets with a standard Instron test device that can be configured in various ways. For example, 3-inch wide strips of tissue or towel can be conditioned at 50% relative humidity and 23° C. (73.4° F.), with the tensile test run at a crosshead speed of 2 in/min. It is noted that CD and MD tensile measurements, indicating directionality, may only be performed on sheets made on a papermachine or by a TAD (or TAD simulation) process, as TAPPI handsheets do not have directionality.

"Tensile energy absorption" ("TEA") refers to the energy absorbing capacity of a tissue. TEA is a measure of the ability of a paper to absorb energy (at the strain rate of the test instrument) and indicates the durability of paper when subjected to either a repetitive or dynamic stressing or straining. TEA is measured in the machine direction (MD TEA) and cross direction (CD TEA) in accordance with TAPPI test method T494 om-01. MD and CD TEA are expressed as energy units per unit of material, for example millimeters-grams/millimeters$^2$ (mm-gm/mm$^2$).

"Stretch" (sometimes evaluated in conjunction with tensile strength) is indicative of the ability of paper to conform to a desired contour, or to survive non-uniform tensile stress. For example, a paper specimen of initial length A increases in length B when a tensile force acts on it. At the instant the specimen breaks, its length has increased to A+B. Then the percent (%) stretch is (B/A)×100. Along with TEA, stretch is an indication of the paper's performance under conditions of dynamic, or repetitive, straining and stressing. Stretch is measured in the machine direction (MD stretch) and cross direction (CD direction) and reported in units of percent (%).

The "void volume," "void volume ratio," or "POROFIL," as used herein refers to the volume of a specimen not occupied by solid material. Void volume is determined by saturating a sheet with a nonpolar liquid and measuring the amount of liquid absorbed. The volume of liquid absorbed is equivalent to the void volume within the sheet structure. Units of void volume are expressed as the percent weight increase, in grams of liquid absorbed per gram of fiber in the sheet structure times 100. More specifically, for each single-ply tissue sample to be tested, 8 sheets are selected, and a 1 inch by 1 inch square (1 inch in the machine direction and 1 inch in the cross-machine direction) is cut out of each sheet. For multi-ply product samples, each ply is measured as a separate entity. Multiple samples should be separated into individual single plies and 8 sheets from each ply position used for testing. The dry weight of each test specimen is measured to the nearest 0.0001 gram, and the specimen is placed in a dish containing POROFIL (sold by Quantachrome Instruments, Boynton Beach, Fla.). After 10 seconds, tweezers are used to grasp the specimen at one corner and remove it from the liquid. Excess liquid is allowed to drip for 30 seconds, and the lower corner of the specimen is lightly dabbed (less than ½ second contact time) on a piece of #4 filter paper (Whatman Lt., Maidstone, England) to remove the last partial drop. The specimen is immediately weighed, and the weight is recorded to the nearest 0.0001 gram. The void volume for each specimen, expressed as grams of POROFIL per gram of fiber, is calculated as: void volume=$[(W_2-W_1)/W_1]$, where $W_1$ is the dry weight of the specimen, in grams, and $W_2$ is the wet weight of the specimen, in grams.

The term "air flow" refers to the air flowing through the tissue paper. The air flow can affect drying rate. For example, restricted air flow results in a slower drying rate and higher energy consumption. Airflow is measured by a two part method, which includes handsheet preparation and air porosity measurement. The method for preparing handsheets for air porosity testing uses a laboratory through air drying (TAD) simulation process. The simulation process includes the following steps: 1) a sample of TAD fabric is cut to match the dimensions of the forming wire of a standard handsheet mold; 2) the TAD fabric is placed on the mold and the mold closed; 3) the mold is filled with water; 4) a measured amount of fiber is placed in the sheet mold and deckeled to mix; 4) the mold is drained to form a web; 5) the mold is opened and the TAD fabric with the web is removed from the mold; 6) the fabric is placed on a TAD simulator which includes a fabric support and vacuum supply; 7) 20 inches of vacuum is applied to the fabric for 15 seconds to mold the web to the TAD fabric and dry the web; 8) the molded sheet is carefully peeled from the TAD fabric for testing. The air porosity measurement uses the Frazier Air Permeability Test, which is based on the test method of TAPPI T 251.

FIG. 1 illustrates a method 100 for making a tissue paper 10 in accordance with an aspect. Any conventional papermaking machine or parts known in the art can be used to make the tissue paper 10. In some aspects, the tissue paper 10 may be formed by compactive dewatering methods. Non-limiting examples of compactive dewatering manufacturing methods include conventional wet pressing (CWP) methods and energy efficient technologically advanced drying eTAD manufacturing methods. In other aspects, the tissue paper 10 may be formed by non-compactive dewatering methods. Non-limiting examples of non-compactive dewatering methods include through air drying (TAD) methods.

An aqueous solution 42 is exposed to a water-soluble gas 22 under a super-atmospheric pressure in a contained environment, including a tank 30, to form a dissolved gas-impregnated solution 44. The tank 30, mixing pump 60, and the headbox 70 define the contained environment, which has a substantially uniform super-atmospheric pressure. The super-atmospheric pressure is a pressure above atmospheric pressure. The super-atmospheric pressure of the contained environment largely maximizes the amount of water-soluble gas 22 dissolved within the dissolved gas-impregnated solution 44. Optionally, the tank 30 included a system to remove any entrained air bubbles after the water-soluble gas 22 is fully dissolved in the aqueous solution 42. The aqueous solution 42 should only include dissolved gas without any macro bubbles. The water-soluble gas 22 can be compressed with a compressor 20. The aqueous solution 42 can be water, include any additional additives, and can be recycled from a conventional de-aeration silo 40.

A fiber slurry 52 comprising cellulosic fibers is combined and mixed with the dissolved gas-impregnated solution 44 in the mixing pump 60 to form a dilute dissolved gas-impregnated fiber slurry 54 comprising dissolved gas-impregnated fibers. The headbox 70 positioned downstream of the mixing pump 60 receives the dilute dissolved gas-impregnated fiber slurry 54 and discharges the dilute dissolved gas-impregnated fiber slurry 54 onto a foraminous support 80 at a lower pressure to form a nascent web 12. The lower pressure is a pressure that is lower than the super atmospheric pressure. In one aspect, the lower pressure is atmospheric pressure. The foraminous support can be any type of support with perforations or holes that enables residual aqueous solution 42 to flow away from the nascent web 12. After forming the nascent web 12, gas bubbles 92 (with diameters greater than 50 micrometers) form from the dissolved water-soluble gas 22. The gas bubbles 92 grow and inhibit hydrogen bonding on the fiber surfaces and in the fiber lumen. Thus the cellulosic fibers expand and/or separate from one another, resulting in a bulkier, fluffier sheet.

Molding of the nascent web 12 on the foraminous support 80 can occur at an absolute pressure sufficient to cause further fiber separation due to the expanded gas bubbles 92. For molding the nascent web 12, a vacuum box (not shown) may be positioned under the foraminous support 80 (opposite the nascent web 12) to pull the nascent web 12 into the voids and pattern of the foraminous support 80. The vacuum box will increase the gas bubbles 92 formed within the web and inhibit fiber-to-fiber bonding in the molding step. Without the gas bubbles 92 the molding step, formed from the dissolved water-soluble gas 22, the nascent web 12 would be compressed, resulting in fiber-to-fiber bonding. However, with less fiber-to-fiber bonding, the nascent web 12 will spring back more after the molding box to provide a higher bulk.

Non-limiting examples of foraminous supports 80 include forming wire, mesh, Fourdrinier wires, and the like. In one aspect, the headbox 70 discharges or sprays the dilute dissolved gas-impregnated fiber slurry 54 as a stream onto the foraminous support 80 at atmospheric pressure. The atmospheric pressure at sea level is about 14.7 psi, but the atmospheric pressure can be a pressure at any altitude above or below sea level. As the dilute dissolved gas-impregnated fiber slurry 54 is discharged onto the foraminous support 80, dissolved water-soluble gas 22 forms gas bubbles 92 to expand and separate the fibers in the sheet. As water-soluble gas 22 forms gas bubbles 92 and travels through the nascent web 12, pockets of air are formed within the matrix of cellulosic fibers. The fibers then expand, separate, or both expand and separate to form a nascent web 12 of at least partially de-gassed fibers. Gas bubbles 92 form within the fibers after the initial nascent web 12 is formed. Additional gas bubbles 92 are formed, further separating the fibers, as the nascent web 12 is dried. Thus, the tissue paper method 100 provides a bulky tissue paper web without chemical debonders.

Although water-soluble gas 22 plays a role in increasing the bulk of the resulting tissue, large gas bubbles 92 (more than 50 micrometers in diameter) are not present during the initial formation. Conventionally, gas or air in papermaking is detrimental because bubbles disrupt the sheet formation. Specifically, large gas bubbles may cause voids in the sheet that are detrimental to the bulk and softness. Large gas bubbles (macro bubbles) also reduce tensile. However, the softest sheet with good formation will be substantially uniform. If the web has holes from large bubbles, there will be a mixture of weak areas (low fiber density) and strong areas (high fiber density). The combination of weak and strong areas results in a sheet that is harsher in hand feel and not as soft. However, aspects of the present invention utilize a system and method in which gas bubbles form from dissolved gas after the sheet formation, as well and in the pressing and drying steps, to interfere with fiber-to-fiber bonding and densification, which results in a bulkier and softer sheet.

The foraminous support 80 carries the nascent web 12 downstream towards a dryer 90. As the nascent web 12 travels along the foraminous support 80, additional gas bubbles 92 are formed within the at least partially de-gassed cellulosic fibers. Excess aqueous solution 42 flows through the foraminous support 80, which partially de-waters the nascent web 12. Optionally, the nascent web 12 is further de-watered by applying a vacuum to the other side of the foraminous support 80. The excess aqueous solution 42 can be sent to a de-aeration silo 40 positioned upstream of the tank 30 to supply recycled aqueous solution. In the de-aeration silo 40, any entrained gas is removed and released as excess gas bubbles 92.

The nascent web 12 can be transferred to a dryer 90, and the transfer step can be conducted at an absolute pressure sufficient to cause further formation of expanded gas bubbles 92. In addition, the nascent web 12 can be pressed prior to drying, which also causes further formation of expanded gas bubbles from within the partially de-gassed fibers of the nascent web 12. Thus, the partially de-gassed fibers remain expanded, separated, or both expanded and separated.

The nascent web 12 can be dried by any method desired. Non-limiting examples of drying methods include air-drying, vacuum air-drying, through air drying (TAD), or heating the nascent web 12 with a dryer 90. Drying can be conducted with a dryer 90 at a temperature sufficient to cause further formation of expanded gas bubbles 92 from within the partially de-gassed fibers of the nascent web 12. Any method of drying (such as TAD) can occur at an absolute pressure sufficient to cause further formation of expanded gas. In one aspect, drying occurs at a temperature in a range of about 250° F. to about 550° F.

The nascent web 12 can be transferred directly from the foraminous support 80 to a Yankee dryer. In another aspect, the nascent web 12 is partially air dried before being transferred to the Yankee dryer. In yet another aspect, the nascent web 12 is supported by an absorbent papermaking felt and transferred to the surface of Yankee dryer. After the tissue paper 10 is dry, it can be dislodged from the Yankee dryer with a doctor blade, which is called creping. Creping generally improves the softness of the tissue paper 10.

Through air drying (TAD) can be used to dry the nascent web 12. In contrast to a Yankee dryer, TAD provides a relatively non-compressive method of removing water from the web by passing hot air through the nascent web 12 until it is dry. For example, the nascent web 12 can be transferred from the foraminous support 80 to a coarse highly permeable through-drying fabric. The nascent web 12 remains on the fabric until dry.

Figure 2:
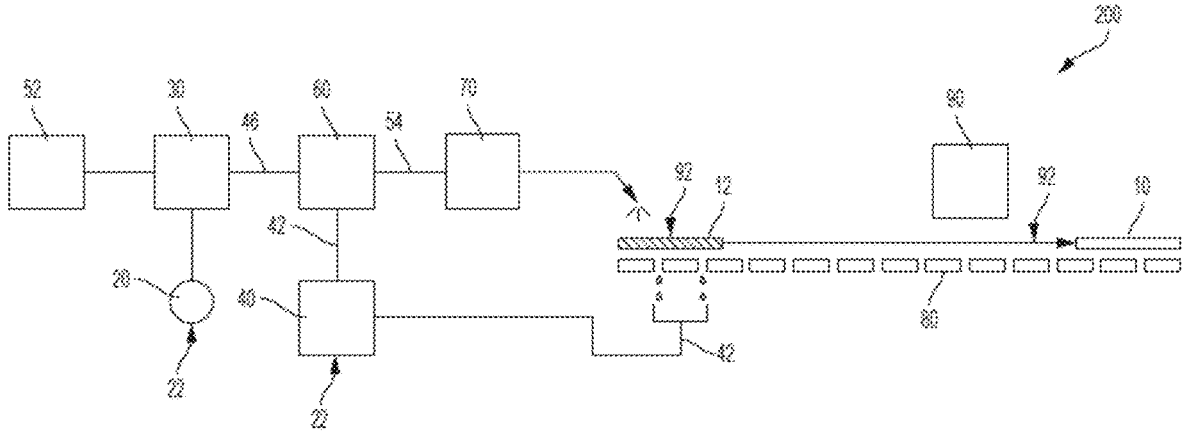
FIG. 2 is a general schematic of another aspect of a method for making a tissue paper in accordance with the present invention.

FIG. 2 illustrates another method 200 for making a tissue paper 10 in accordance with another aspect. In this aspect, a fiber slurry 52 is exposed to a water-soluble gas 22 under a super-atmospheric pressure in a contained environment to form a dissolved gas-impregnated fiber slurry 46. The fiber slurry 52 is exposed to the water-soluble gas 22 in a tank 30. The tank 30, mixing pump 60, and the headbox 70 define the contained environment, which is described above. The dissolved gas-impregnated fiber slurry 46 is then mixed with an aqueous solution 42 to form a dilute dissolved gas-impregnated fiber slurry 54. The remaining steps of method 200 are as described above for method 100 (see FIG. 1).

In another aspect, the dilute dissolved gas-impregnated fiber slurry 54 is formed by first forming a dilute fiber slurry (not shown). The aqueous solution 42 and the fiber slurry 52 can be mixed to form the dilute fiber slurry, which is then exposed to the water-soluble gas 22 under the super-atmospheric pressure of the contained environment to form the dilute dissolved gas-impregnated fiber slurry 54.

Figure 10:
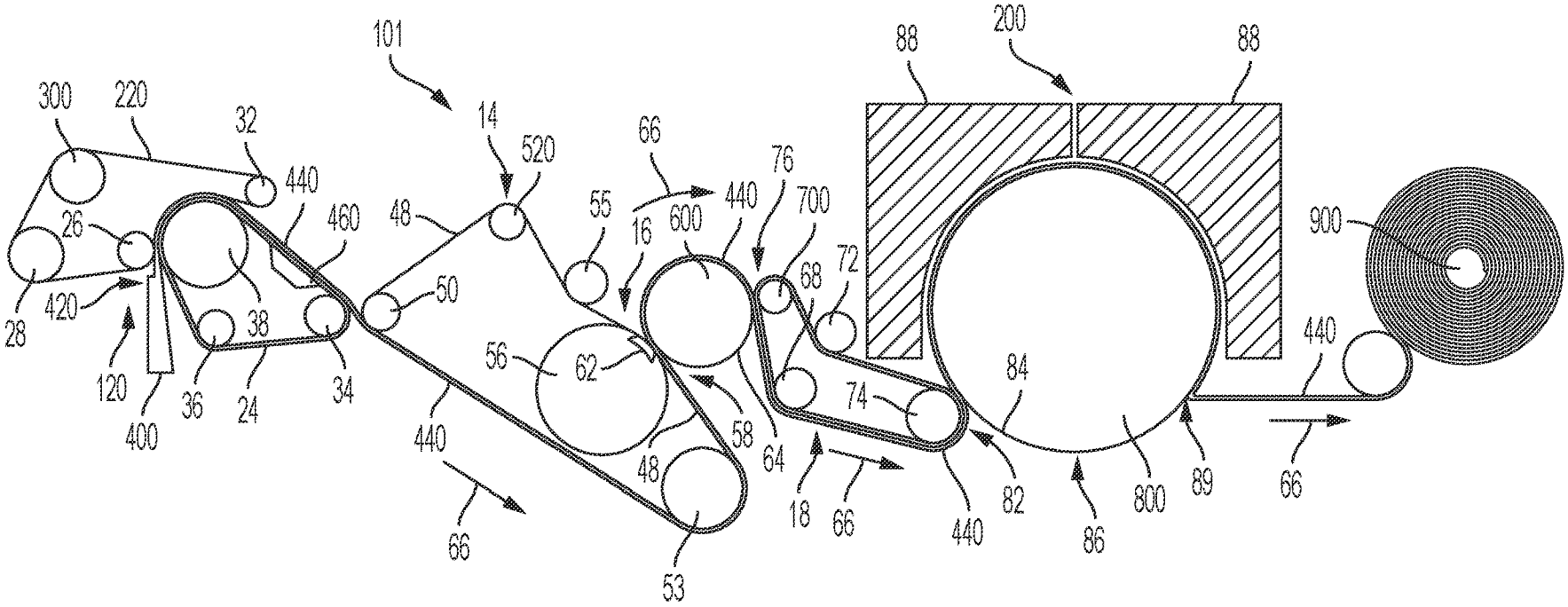
FIG. 10 is a general schematic of a tissue machine for making a tissue paper in accordance with an aspect of the present invention.

FIG. 10 is a general schematic of a tissue machine for making a tissue paper in accordance with aspects of the present invention. Papermachine 101 includes a conventional twin wire forming section 120, a felt run 14, a shoe press section 16, a creping fabric 18, and a Yankee dryer 800. Forming section 120 includes a pair of forming fabrics 220, 24 supported by a plurality of rolls 26, 28, 300, 32, 34, 36 and a forming roll 38. A headbox 400 provides papermaking furnish to a nip 420 between forming roll 38 and roll 26 and the fabrics. The furnish forms a nascent web 440 which is dewatered on the fabrics with the assistance of vacuum, for example, by way of vacuum box 460.

The dissolved gas impregnated solution is supplied to the headbox 400. The nascent web 440 forms around forming roll 38 between inner forming fabric 24 and outer forming fabric 220. The dissolved gas forms bubbles in the nascent web 440 and the fiber lumens as the web travels from forming roll 38 to the Yankee dryer 800. The gas bubbles inhibit the formation of hydrogen bonds in the web, resulting in expansion and/or separation of the fibers.

The nascent web 440 moves in the machine direction 66, which is the machine direction (MD). The nascent web 440 is advanced to a papermaking felt 48, which is supported by a plurality of rolls 50, 520, 53, 55, and the felt is in contact with a shoe press roll 56. Vacuum roll 50 transfers the web to papermaking felt 48. The vacuum applied to the web increases bubble formation, which inhibits hydrogen bonding in the web.

The web enters nip 58 where the web is pressed by shoe press 62 between shoe press roll 56 and transfer roll 600. Transfer roll 600 has a smooth surface 64, which may be provided with adhesive and/or release agents if needed. Nascent web 440 continues to advance in the machine direction 66. The web is pressed by the shoe press 62 to increase solids to about 15%. The bubbles in the sheet inhibit hydrogen bonding at the shoe press 62 and reduce sheet compaction and strength increases. The pressure pulse at nip 58 may also increase the gas bubble formation, further resisting bonding in the sheet.

The web enters fabric creping nip 76 where the sheet is decelerated by creping fabric 18, which is running at a lower linear speed than transfer roll 600. Creping fabric 18 is supported on a plurality of rolls 68, 700, 72 and transfer roll 74. The creping fabric 18 is adapted to contact transfer roll 600. Creping roll 700 may include a soft deformable surface which will increase the length of the creping nip and increase the fabric creping angle between the fabric and the sheet and the point of contact.

The sheet is then transferred to Yankee dryer 800 at transfer nip 82. Transfer roll 74 presses the sheet against the hot Yankee dryer surface and the sheet attaches to the smooth Yankee surface 84. The heating of the sheet at transfer nip 82 increases gas bubble formation to help inhibit hydrogen bonding. Adhesives are typically sprayed on the Yankee surface 84 at region 86 prior to the contact of the sheet to aid transfer and heat transfer. The web is dried on Yankee dryer 800, which is a heated cylinder and by high jet velocity impingement air in Yankee hood 88. As the sheet is heated on the Yankee surface 84, the remaining air is driven out of solution and provides additional bulking of the sheet. The substantially dry sheet is creped off the Yankee surface 84 by creping blade 89, which also provides kinetic energy to the sheet increasing the bulk and softness. Finally the sheet is rolled up on reel 900.

Figure 11:
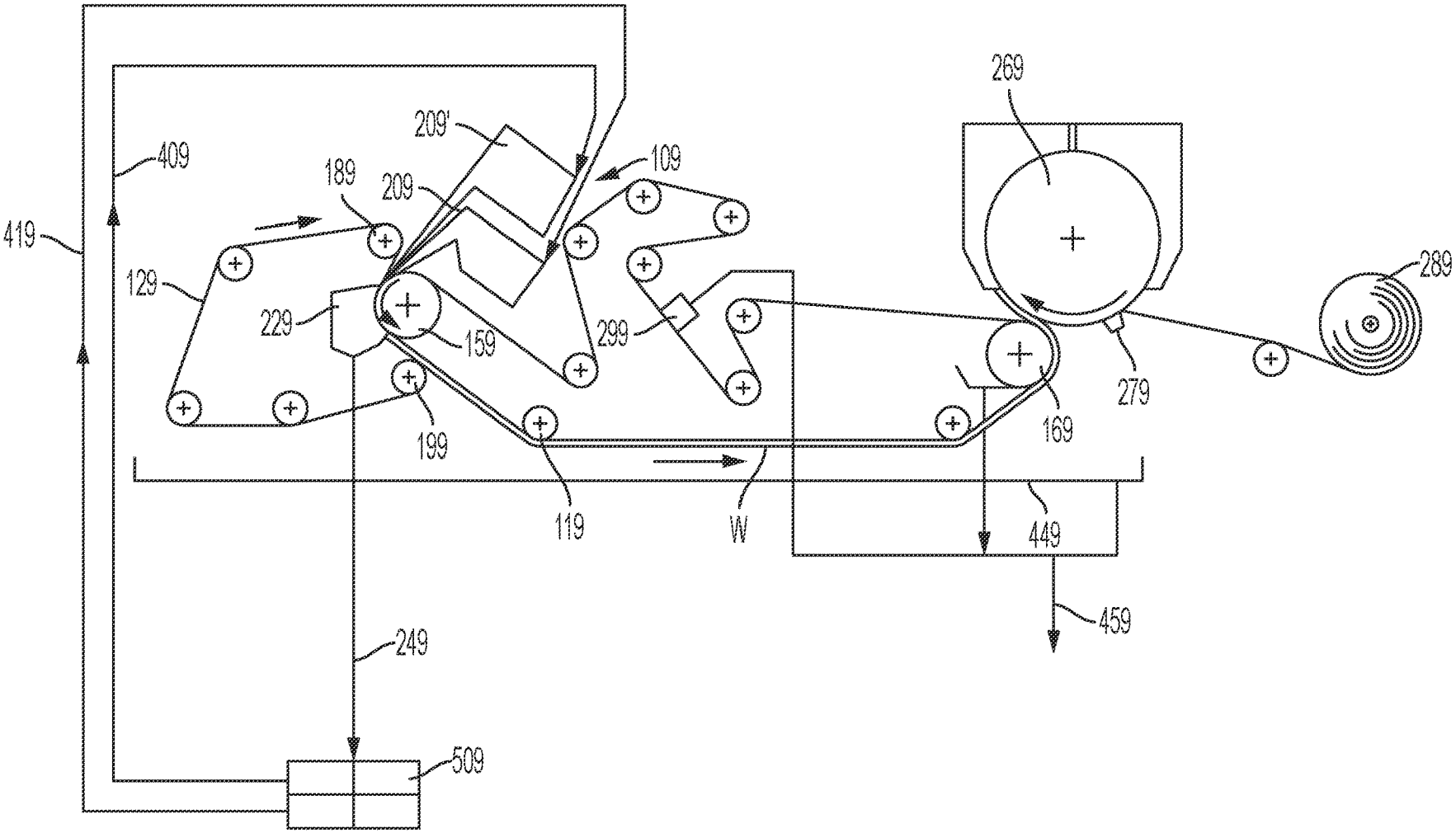
FIG. 11 is a general schematic of a tissue machine for making a tissue paper in accordance with an aspect of the present invention.

FIG. 11 is a general schematic of a tissue machine for making a tissue paper in accordance with aspects of the present invention. The tissue machine is a conventional wet pressed paper machine with a dual layer headbox and crescent forming technology. Silo 509 is used for preparing furnishes that are preferentially treated with chemicals having different functionality depending on the character of the various fibers particularly fiber length and coarseness. The differentially treated furnishes are transported through different conduits, 409 and 419, where the furnishes are delivered to the headbox of a crescent forming machine 109. The machine includes a web-forming end or wet end with a liquid permeable foraminous support member 119, which may be of any conventional configuration. Foraminous support member 119 may be constructed of any of several known materials, including photo polymer fabric, felt, fabric or a synthetic filament woven mesh base with a very fine synthetic fiber batt attached to the mesh base. The foraminous support member 119 is supported in a conventional manner on rolls, including breast roll 159 and couch roll or pressing roll 169.

Press wire 129 is supported on rolls 189 and 199, which are positioned relative to the breast roll 159 for pressing the press wire 129 to converge on the foraminous support member 119 at the cylindrical breast roll 159 at an acute angle relative to the foraminous support member 119. The foraminous support member 119 and the press wire 129 move in the same direction and at the same speed which is the same direction of rotation of the breast roll 159. The pressing wire 129 and the foraminous support member 119 converge at an upper surface of the breast roll 159 to form a wedge-shaped space or nip into which two jets of water or foamed-liquid fiber dispersion is pressed between the pressing wire 129 and the foraminous support member 119 to force fluid through the press wire 129 into a tray 229 where it is collected for reuse in the process.

The dissolved gas impregnated solution is supplied to the multilayer headbox and can be sullied to the outer headbox 209', the inner headbox 209, or both. It is believed to be preferential to add the solution to outer headbox 209', which faces the Yankee dryer, to provide a higher softness or better hand feel. The web W forms between foraminous support member 119 and pressing wire 129 with most of the water going through pressing wire 129 and to tray 292. The dissolved gas forms bubbles in the web W and the fiber lumens as the web W travels from breast roll 159 to pressing roll 169. The gas bubbles inhibit the formation of hydrogen bonds in the web.

At pressing roll 169, the sheet is compressed against the hot Yankee dryer surface 269 and attaches to the smooth Yankee surface. A pit 449 collects water squeezed from the furnish by the pressing roll 169 and a Uhle box 299. The water collected in the pit 449 may be collected into a flow line 459 for separate processing. Gas bubbles in the web W are especially beneficial in the pressing zone to prevent hydrogen bonding in this area, which reduces the softness and bulk of the sheet. Adhesives are typically sprayed on the Yankee surface prior to the contact of the sheet to aid transfer and heat transfer. As the sheet is heated on the Yankee surface, the remaining bubbles are driven out of solution, which provides additional bulking of the sheet. The substantially dry sheet is creped off the Yankee surface by creping blade 279, which also provides kinetic energy to the sheet increasing the bulk and softness. Finally the sheet is rolled up on reel 289.

The water collected in tray 249 flows by gravity to silo 509. The water flows downward through silo 509 and is reused to dilute the stock. The silo 509 is designed to provide a slow enough downward velocity so that air bubbles entrained in the flow, or bubbles formed from residual dissolved air, rise to the top and separate from the water.

Although not shown, additional de-aeration equipment might be used to de-aerate the silo water before being reused.

The Compressed, Water-Soluble Gas

Macro bubbles of entrained air and gases can be detrimental in conventional papermaking operations and in resulting products. For example, unfavorable effects on tissue paper webs can include holes, strength losses, and poor formation. Thus, paper machines, tissue paper methods, and water systems are conventionally designed to remove entrained and macro bubbles of gases from water, aqueous solutions, and fiber slurries.

However, it has been discovered in the present invention that a water-soluble gas can be used to produce a soft, bulky tissue. Chemical debonders and through air drying (TAD) are commonly used in tissue production to reduce tissue paper web strength, which enhances the bulk and perceived softness. Although chemical debonders and TAD produce desirable tissues, these methods are capital intensive, energy demanding, and carry inherently high operating costs. As discussed above, water-soluble gas can be used to initially form a web. Gas bubbles form within the web after initial formation. The gas bubbles travel through the web and inhibit fiber to fiber bonding after formation and during the drying process, resulting in expansion and/or separation of partially de-gassed fibers, which provides a bulky tissue without chemical debonders. Although, in some aspects, chemical debonders may be added to further increase bulk and softness.

The nascent web can be partially de-watered by draining and air-drying on the foraminous support, which substantially reduces operating costs from energy-intensive drying. Thus, although not required, through air drying can be used at reduced operating costs. Although, through air drying of the nascent web produced in accordance with the present invention could occur at an increased rate compared to nascent webs without compressed gas because of the increased openness of the web pore structure.

In one aspect, the water-soluble gas is air. In another aspect, the water-soluble gas is nitrogen gas, oxygen gas, argon gas, or any combination thereof. In yet another aspect, the water-soluble gas is compressed with a compressor. The water-soluble gas does not derive from gas-evolving chemicals, for example calcium carbonate, hydrochloric acid, and the like. Further, the water-soluble gas does not derive from subjecting the fiber slurry or aqueous solution to high temperatures or any chemical treatment.

The amount of water-soluble gas that will dissolve in the aqueous solution or fiber slurry is proportional to the absolute pressure, in accordance with Henry's law constant. Thus, the gas will go into solution, and remain in solution, under a super-atmospheric pressure. The super-atmospheric pressure saturates the aqueous solution or fiber slurry to form a dilute dissolved gas-impregnated fiber slurry. The super-atmospheric pressure can be in a range between about 10 and 60 psig. In one aspect, the super-atmospheric pressure is at least about 20 psig. In another aspect, the super-atmospheric pressure is greater than about 30 psig. Still yet, in another aspect, the super atmospheric pressure is about or in any range between about 10, 15, 20, 25, 30, 35, 40, 45, 50, and 60 psig.

Chemical Debonders

In one aspect, the final tissue paper web is substantially free of chemical debonders, which sometimes are referred to as softeners. In another aspect, the tissue paper web includes some chemical debonder that may be used to further increase the softness. In another aspect, the tissue paper web includes between about 0.1 lb/ton and about 4.0 lb/ton chemical debonder. Debonders are commonly incorporated with the fiber slurry before, during, or after forming the nascent web. Non-limiting examples of chemical debonders include cationic surfactants, anionic surfactants, non-ionic surfactants, amphoteric surfactants, waxes, or any combination thereof.

Examples of cationic surfactants include, but are not limited to, long chain amines; quaternary ammonium salts such as di($C_8$-$C_{24}$)alkyldimethylammonium chloride or bromide; di($C_{12}$-$C_{18}$)alkyldimethylammonium chloride or bromide; distearyidimethylammonium chloride or bromide; ditallowalkyldimethylammonium chloride or bromide; dioleyldimethylammonium chloride or bromide; dicocoalkyldimethylammonium chloride or bromide; ($C_8$-$C_{24}$)alkyldimethylethyl-ammonium chloride or bromide; ($C_8$-$C_{24}$) alkyltrimethylammonium chloride or bromide; cetyltrimethylammonium chloride or bromide; ($C_{20}$-$C_{22}$) alkyltrimethylammonium chloride or bromide; ($C_8$-$C_{24}$)alkyldimethylbenzyl-ammonium chloride or bromide; N—($C_{10}$-$C_{18}$)alkylpyridinium chloride or bromide; N—($C_{10}$-$C_{18}$) alkylisoquinolinium chloride, bromide or monoalkylsulfate; N—($C_{12}$-$C_{18}$)alkylpolyoylaminoformylmethyl-pyridinium chloride; N—($C_{12}$-$C_{18}$)alkyl-N-methylmorpholinium chloride, bromide or monoalkylsulfate; N—($C_{12}$-$C_{18}$)alkyl-N-ethylmorpholinium chloride, bromide or monoalkylsulfate; ($C_{16}$-$C_{18}$)alkylpentaoxethylammonium chloride; diisobutylphenoxyethoxyethyldimethylbenzylammonium chloride; salts of N,N-diethylaminoethylstearylamide and -oleylamide with hydrochloric acid, acetic acid, lactic acid, citric acid, and phosphoric acid; N-acylaminoethyl-N,N-diethyl-N-methylammonium chloride, bromide or monoalkylsulfate; and N-acylaminoethyl-N,N-diethyl-N-benzylammonium chloride, bromide or monoalkylsulfate, where acyl is stearyl or oleyl; and combinations thereof.

Examples of anionic surfactants include, but are not limited to, sulfates, such as sodium laureth sulfate; ammonium laureth sulfate; alkylpolysaccharide sulfates, such alkylpolyglycoside sulfates; branched primary alkyl sulfates; alkyl glyceryl sulfates; alkenyl glyceryl sulfates; alkylphenol ether sulfates; or oleyl glyceryl sulfates; alkyl succinates; sulfonates, such as alkylbenzene sulfonates; or alkyl ester sulfonates, including linear esters of $C_8$-$C_{20}$-carboxylic acids (i.e. fatty acids) which are sulfonated by means of gaseous $SO_3$ carboxylates; phosphates, such as alkyl phosphates; alkyl ether phosphates; isethionates, such as acyl isethionates; sulfosuccinates, including monoesters of sulfosuccinates (such as saturated and unsaturated $C_{12}$-$C_{18}$ monoesters); or diesters of sulfosuccinates (such as saturated and unsaturated $C_{12}$-$C_{18}$ diesters); acyl sarcosinates, such as those formed by reacting fatty acid chlorides with sodium sarcosinate in an alkaline medium; salts of acylaminocarboxylic acids, such as salts of alkylsulfamidocarboxylic acids; N-acyltaurides; and combinations thereof. Suitable starting materials for anionic surfactants are natural fats, such as tallow, coconut oil and palm oil, but can also be of a synthetic nature.

Examples of nonionic surfactants include, but are not limited to, glucosides, such as lauryl glucoside and decyl glucoside, and the ethoxylated alcohols and ethoxylates of long-chain, aliphatic, synthetic or native alcohols having a $C_8$-$C_{22}$ alkyl radical. These ethoxylated alcohols and can contain from about 1 to about 25 moles of ethylene oxide. The alkyl chain of the aliphatic alcohols can be linear or branched, primary or secondary, saturated or unsaturated. Condensation products of $C_{10}$-$C_{18}$ alcohols with from about 2 to about 18 moles of ethylene oxide per mole of alcohol can be used. The alcohol ethoxylates can have a narrow homolog distribution ("narrow range ethoxylates") or a broad homolog distribution of the ethylene oxide ("broad range ethoxylates"). Amides-fatty acid combinations, such as coconut amides, including cocamide diethanolamine, cocamide monoethanolamine, are additional examples.

Examples of amphoteric surfactants include, but are not limited to, betaines, sultaines, imidazoline derivatives, and the like. Typical amphoteric surfactants include disodium cocoamphodiacetate, ricinoleamidopropyl betaine, cocamidopropyl betaine, stearyl betaine, stearyl amphocarboxy glycinate, sodium lauraminopropionate, cocoamidopropyl hydroxy sultaine, disodium lauryliminodipropionate, tallowiminodipropionate, cocoampho-carboxy glycinate, cocoimidazoline carboxylate, lauric imidazoline monocarboxylate, lauric imidazoline dicarboxylate, lauric myristic betaine, cocoamidosulfobetaine, alkylamidophospho betaine, and combinations thereof.

The Fiber Slurry

The fiber slurry includes cellulosic fibers in an aqueous carrier. Cellulosic fibers include any fibers incorporating cellulose as a constituent. In one aspect, the cellulosic fibers are secondary, recycled fibers. In another aspect, the cellulosic fibers are derived from hardwood fibers, such as hardwood kraft fibers, hardwood sulfite fibers; softwood fibers, such as softwood kraft fibers, softwood sulfite fibers; or any combination thereof. The fibers can be mechanical fibers.

The fiber slurry has a consistency in a range between about 0.01% to about 5%. In another aspect, the fiber slurry has a consistency in a range between about 1% to about 4%. The dissolved gas-impregnated fiber slurry has the same consistency as the fiber slurry. Still yet, in another aspect, the fiber slurry has a consistency about or in any range between about 0.1, 0.5, 1.0, 1.5, 2.0, 2.5, 3.0, 3.5, 4.0, 4.5, and 5.0%.

The dilute dissolved gas-impregnated fiber slurry has a consistency in a range between about 0.01% to about 5%. In another aspect, the dilute dissolved gas-impregnated fiber slurry has a consistency in a range between about 1% to about 4%. Yet, in another aspect, the dilute dissolved gas-impregnated fiber slurry has a consistency in any range between about 0.5 and about 3.0%. Still yet, in another aspect, the dilute dissolved gas-impregnated fiber slurry has a consistency about or in any range between about 0.1, 0.5, 1.0, 1.5, 2.0, 2.5, 3.0, 3.5, 4.0, 4.5, and 5.0%.

The temperature of the fiber slurry and dilute dissolved gas-impregnated fiber slurry during manufacture is less than 50° C. The lower the temperature, the higher the dissolved air capacity. In another aspect, the temperature of the fiber slurry and the dilute dissolved gas-impregnated fiber slurry is less than about 40° C., or less than about 30° C. Yet in another aspect, the temperature of the fiber slurry and dilute dissolved gas-impregnated fiber slurry is about or in any range between about 30, 35, 40, 45, and 50° C.

The fiber slurry and the dilute dissolved gas-impregnated fiber slurry can include any additional additives, in any amount, known to the skilled artisan. Non-limiting examples of additives include surface modifiers, strength aids, latexes, opacifiers, optical brighteners, dyes, pigments, sizing agents, barrier chemicals, retention aids, insolubilizers, organic or inorganic cross-linkers, or any combination thereof.

Properties of the Tissue Paper Web

The tissue paper has a basis weight in a range between about 5 lb/3,000 $ft^2$ to about 45 lb/3,000 $ft^2$. In another aspect, the basis weight is in a range between about 8 lb/3,000 $ft^2$ to about 30 lb/3,000 $ft^2$. Yet, in another aspect, the basis weight is in a range between about 10 lb/3,000 $ft^2$ to about 20 lb/3,000 $ft^2$. Still yet, in another aspect, the basis weight is about or in any range between about 5, 7, 10, 22, 25, 27, 30, 32, 35, 37, 40, 42, and 45 lb/3,000 $ft^2$.

The tissue paper has a caliper in a range between about 50 mils/8 sheets and about 350 mils/8 sheets. In another aspect, the caliper is in a range between about 125 mils/8 sheets and about 275 mils/8 sheets. Yet, in another aspect, the caliper is in a range between about 100 mils/8 sheets and about 200 mils/8 sheets. Still yet, in another aspect, the caliper is about or in any range between about 5, 10, 20, 30, 40, 50, 60, 70, 80, 90, 100, 110, 120, 130, 140, 150, 160, 170, 180, 190, 200, 210, 220, 230, 240, 250, 260, 270, 280, 290, 300, 310, 320, 330, 340, and 350 mils/8 sheets.

The tissue paper has a GMT in a range between about 500 and about 5,000 g/3 in. In another aspect, the GMT is in a range between about 500 and about 2,500 g/3 in. Yet, in another aspect, the GMT is in a range between about 1,000 and about 3,000 g/3 in. Still yet, in another aspect, the GMT is about or in any range between about 500, 750, 1000, 1250, 1500, 1750, 2000, 2250, 2500, 2750, 3000, 3250, 3500, 3750, 4000, 4250, 4500, 4750, and 5000 g/3 in.

The tissue paper has a CD tensile in a range between about 170 and about 500 g/3 in. In another aspect, the CD tensile is in a range between about 200 and about 400 g/3 in. Yet, in another aspect, the CD tensile is in a range between about 250 and about 450 g/3 in. Still yet, in another aspect, the CD tensile is in any range between about 170, 200, 230, 250, 270, 300, 33, 350, 370, 400, 430, 450, 470, and 500 g/3 in.

The tissue paper has a MD tensile in a range between about 450 and about 900 g/3 in. In another aspect, the MD tensile is in a range between about 550 and about 800 g/3 in. Yet, in another aspect, the MD tensile is in a range between about 600 and about 750 g/3 in. Still yet, in another aspect, the MD tensile is in any range between about 450, 500, 550, 600, 650, 700, 750, 800, 850, and 900 g/3 in.

When the tissue paper is a towel, the CD tensile is in a range between about 1200 and about 2500 g/3 in. In another aspect, the CD tensile of the towel is in a range between about 1500 and about 2000 g/3 in. Yet, in another aspect, the CD tensile of the towel is in a range about or in any range between about 1200, 1400, 1600, 1800, 2000, 2200, 2400, and 2500 g/3 in.

When the tissue paper is a towel, the MD tensile is in a range between about 2000 and about 3500 g/3 in. In another aspect, the MD tensile of the towel is in a range between about 2500 and about 3000 g/3 in. Yet, in another aspect, the MD tensile of the towel is in a range between about 2000, 2100, 2200, 2300, 2400, 2500, 2600, 2700, 2800, 2900, 3000, 3100, 3200, 3300, 3400, and 3500 g/3 in.

Figure 12:
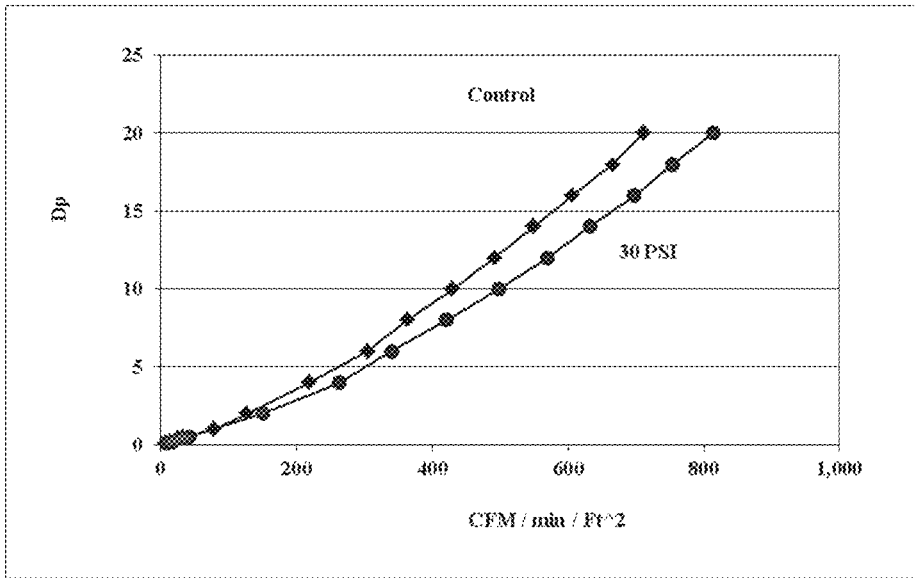
FIG. 12 is a graph of delta pressure Dp (inches water column (inches W.C.)) as a function of air flow (CFM/min/$ft^2$)

The tissue papers described herein have improved air flow or air permeability at a given pressure when compared to tissue papers made without gas impregnation. In some aspects, air flow ($ft^3/min/ft^2$) increases about 22% to about 107%, depending on the pressure differential (inches of water column (inches W.C.)). As mentioned above, air flow is measured in accordance with the Frazier Air Permeability Test, which is based on the test method of TAPPI T 251. Air flow ($ft^3/min/ft^2$) are measured as a function of delta pressure (Dp) (inches water column (in. WC)). Velocity/pressure (V/P) ($ft^3/min/ft^2$)/in. WC)) can then be plotted against pressure$^{-0.5}$ ($P^{-0.5}$) as shown in FIGS. 12 and 13, discussed in the Examples 5 and 6 below.

At a given pressure differential, the air flow through a sheet of paper depends on many factors, including the basis weight, pore size, and pore shape. At very low differential pressure, less than about 0.5 in WC, the air flow is directly proportional to the differential pressure, approximately following Darcy's Law. As the pressure differential increases, inertial forces become the predominant resistance to air flow. Inertial forces arise from the acceleration and deceleration of the air as it follows a non-linear path through the pores in the web. Thus air flow behavior at higher differential pressures provides an indication of the pore structure of a paper web. For paper webs produced with the same fiber furnish, forming method, forming fabrics, dewatering and drying methods, and basis weights, differences in the relationship between air flow and differential pressure are a function of the pore structure of the web.

After plotting velocity/pressure (V/P) ($ft^3/min/ft^2$)/in. WC)) against $P^{-0.5}$, for example as shown in FIG. 13, the slope of the resulting line is determined and compared for gas-impregnated sheets and non-gas-impregnated sheets. In one example, FIG. 13 compares V/P against $1/P^{0.5}$ for 30 PSI gas-impregnated tissue papers (circle data points) and control (non-gas-impregnated) tissue papers (diamond data points). The fit of the line for the gas-impregnated tissue papers is defined by 93.033x+20.168. The fit of the line for the non-gas-impregnated tissue papers is defined by 74.845x+19.178. In this example, the slope of the line for the gas-impregnated tissue papers is about 24% greater than the slope of the line of the non-gas-impregnated tissue papers at higher differential pressures, for example greater than 8 inches WC. However, these particular data points and fitted lines are only one example, and other data points and fitted lines may result depending on a variety of other factors.

Figure 13:
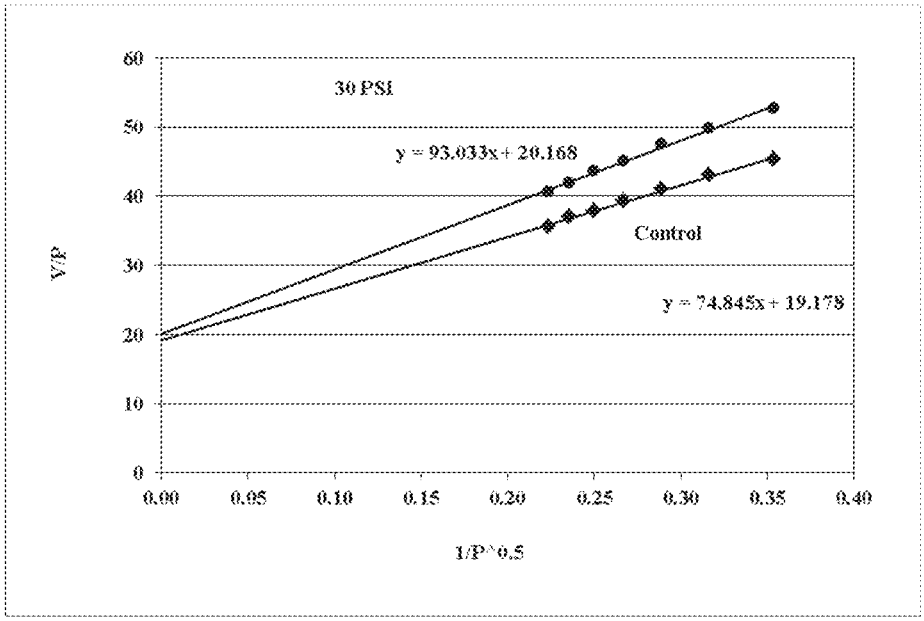
FIG. 13 is a graph of velocity pressure (V/P) as a function of $1/P^{0.5}$.

The gas-impregnated sheets made as described herein exhibit an increased slope compared to the non-gas-impregnated sheets (see FIG. 13 for example). In one aspect, a gas-impregnated tissue paper substantially free of a chemical debonder and has a percent increase in slope of velocity/pressure (($feet^3/min/feet^2$)/inches water column) as a function of $1/P^{0.5}$ of at least 22% compared to a like non-gas-impregnated tissue paper; wherein P is pressure from about 8 inches water column to about 20 inches water column. In other aspects, the percent increase in slope is at least 15%, at least 18%, at least 20%, at least 22%, at least 24%, at least 26%, at least 28%, or at least 30% greater for gas-impregnated sheets compared to non-gas-impregnated sheets.

all such modifications are intended to be included within the scope of the present invention.

EXAMPLES

Examples 1-4

In Examples 1-4, tissue papers were prepared with secondary, recycled fibers. The sheets were pressed per standard TAPPI procedure, placed in restraining rings, and air-dried overnight.

In Example 1, control tissue papers were prepared without compressed air using the sheet preparation procedure TAPPI T-205 and a standard sheet forming machine.

In Example 2, air-impregnated water was mixed with a fiber slurry to form a dilute air-impregnated fiber slurry. The air-impregnated water was prepared by adding 6 liters of water to an 8 liter stainless steel tank equipped with a hand air pump and a pressure gauge. The tank was sealed, air was pumped into the tank to a target pressure of 30 psig, and the tank was placed on a mechanical agitator for 8 minutes at approximately 2 cycles per second. The tank was removed from the agitator, opened to relieve pressure, and the 6 liters of air-impregnated water was added to the sheet machine or paper mould. The fiber slurry was combined with 2 liters of water, and the resulting fiber slurry was added to the sheet machine. Tissue sheets were formed per standard TAPPI procedure above.

In Examples 3-4, the fiber slurry was mixed with 6 liters of water in the tank. The tank was sealed and pumped with air to a target pressure of 20 psig (Examples 3) or 30 (Example 4) psig to form an air-impregnated fiber slurry. The tank was agitated as described above. The fiber slurry was combined with 2 liters of water to form a dilute air-impregnated fiber slurry, which was added to the sheet machine. Tissue sheets were formed per standard TAPPI procedure above.

Table 1 provides the basis weight, bulk, tensile, and normalized tensile of the tissue sheets prepared in Examples 1-4. As indicated, tissue sheets prepared with dissolved air had increased bulk and decreased tensile strength compared to control tissue sheets.

TABLE 1

| | | Basis Weight | | Bulk | Tensile |
|---|---|---|---|---|---|
| Example | Description | (lb./3,000 $ft^2$) | ($g/m^2$) | ($cm^3/g$) | (kg/15 mm) |
| 1 | Control | 39.80 | 64.77 | 2.16 | 2.17 |
| 2 | Air-sat. water + fiber slurry | 40.52 | 65.95 | 1.79 | 1.77 |
| 3 | Fiber slurry sat. with 20 psi air | 39.65 | 64.53 | 2.06 | 2.08 |
| 4 | Fiber slurry sat. with 30 psi air | 39.52 | 64.32 | 1.99 | 2.01 |

Use

The tissue paper of the present invention can be used as facial tissue. In another aspect, the tissue paper can be used any type of low density paper, such as a paper towel, a bath tissue, a napkin or any other type of tissue.

Figure 3:
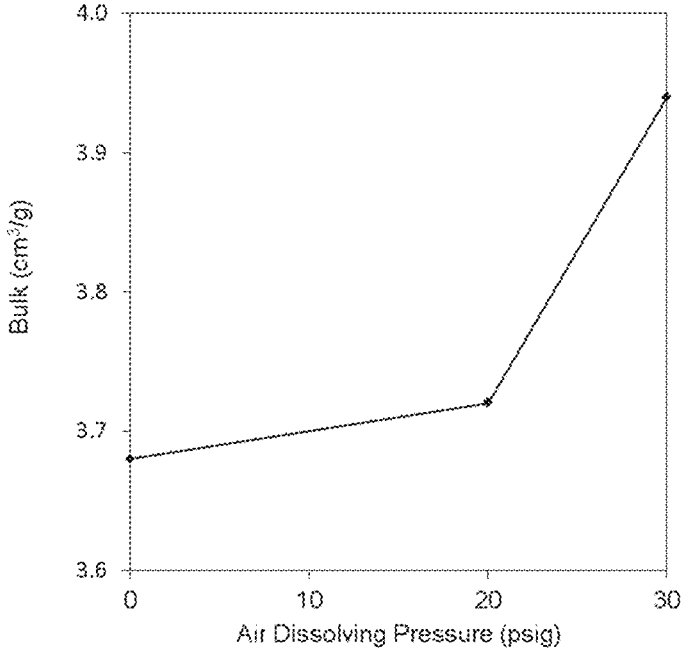
FIG. 3 is a graph of tissue paper bulk as a function of air dissolving pressure within a contained environment during manufacture in accordance with an aspect of the present invention.

To provide a more complete understanding of the present invention and not by way of limitation, reference is made to the following examples. Accordingly, the examples are to be regarded in an illustrative rather than restrictive sense, and FIGS. 3-9 illustrate properties of tissue sheets prepared in Examples 1-4. FIG. 3 illustrates the difference in bulk of tissue papers prepared with dissolved air and without dissolved air. Increasing tissue paper bulk increases the softness. As shown, bulk ($cm^3/g$) increased as a function of the super-atmospheric pressure (psi), or air-dissolving pressure, applied in the contained environment.

Figure 4:
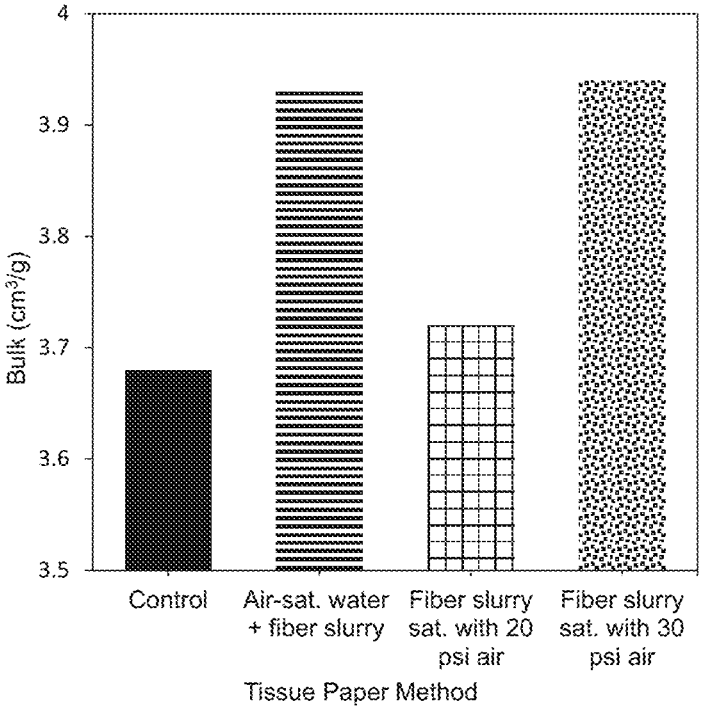
FIG. 4 is a graph of tissue paper bulk in tissues prepared with and without compressed air in accordance with an aspect of the present invention.

FIG. 4 illustrates the impact of the point of dissolved air addition on tissue paper bulk. Whether air was dissolved in the aqueous solution, as in method 100 (FIG. 1) (horizontal line fill) or the fiber slurry, as in method 200 (FIG. 2)

(cross-hatch fill and dotted fill), bulk ($cm^3/g$) increased compared to control tissue papers without dissolved air (solid fill control).

Figure 5:
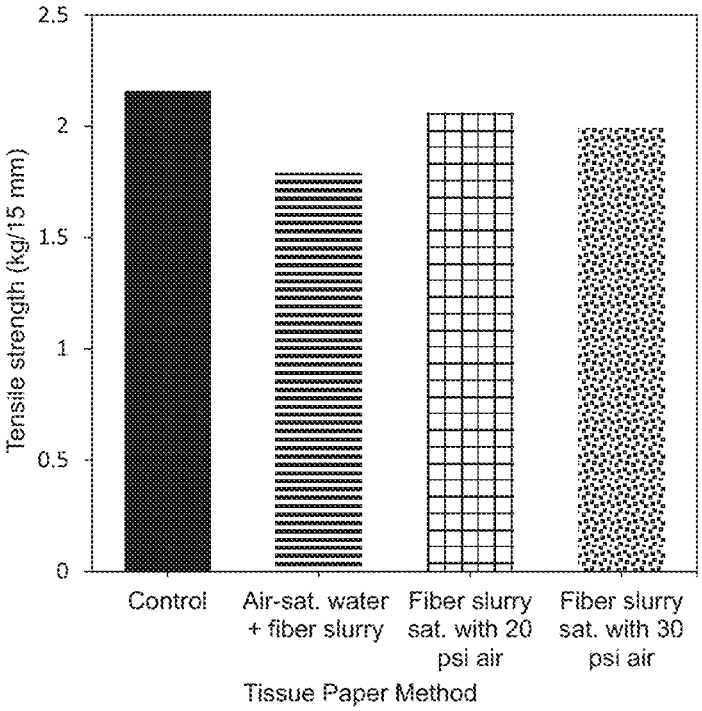
FIG. 5 is a graph of tissue paper tensile strength in tissues prepared with and without compressed air in accordance with an aspect of the present invention.

FIG. 5 illustrates the impact of the point of dissolved air addition on tissue paper tensile strength. Decreased tensile strength (kg/15 mm), together with increased bulk, provides a softer tissue paper. Only tissue paper prepared according to method 100 (FIG. 1) (horizontal line fill), where air is dissolved in the aqueous solution, demonstrated a slightly lower tensile strength compared to control tissue papers prepared without dissolved air (solid fill). Tissue papers prepared according to method 200 (FIG. 2) (cross-hatch fill and dotted fill) had similar tensile strengths compared to the control tissue papers.

Figure 6:
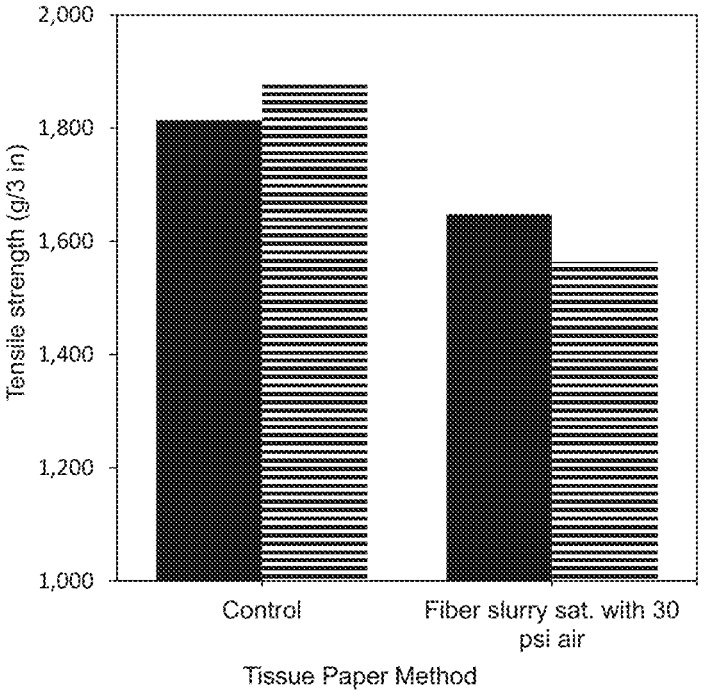
FIG. 6 is a graph of tissue paper CD and MD tensile strengths in tissues prepared with and without compressed air in accordance with an aspect of the present invention.

FIG. 6 illustrates CD (solid fill) and MD (horizontal line fill) tensile strengths (g/3 in) of tissue papers prepared with dissolved air according to method 200 (FIG. 2) (fiber slurry sat. with 30 psi air) compared to control tissue papers without dissolved air. As shown, tissue papers prepared with dissolved air had slightly decreased CD and MD tensile strengths compared to controls.

Figure 7:
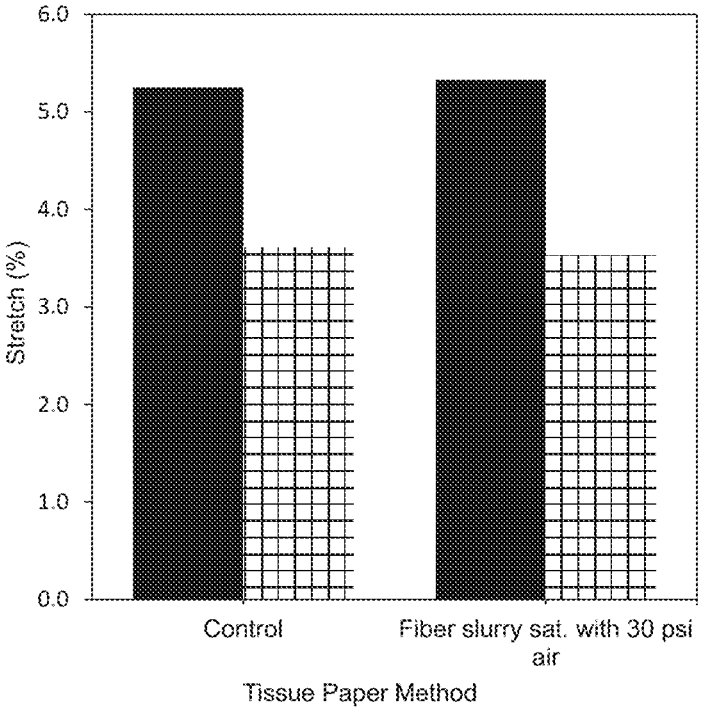
FIG. 7 is a graph of tissue paper CD and MD stretch in tissues prepared without compressed air in accordance with an aspect of the present invention.

FIG. 7 illustrates CD (solid fill) and MD (cross-hashed fill) stretch of tissue papers prepared with dissolved air according to method 200 (FIG. 2) (fiber slurry sat. with 30 psi air) compared to control tissue papers without dissolved air. As shown, tissue papers prepared with dissolved air have comparable CD and MD stretches compared to control tissue papers.

Figure 8:
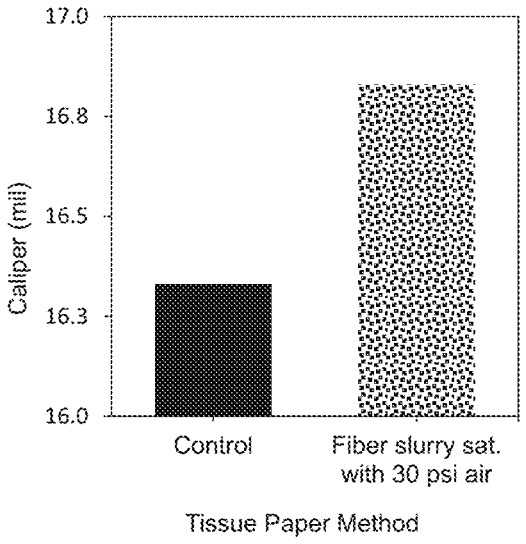
FIG. 8 is a graph of tissue paper caliper in tissues prepared with and without compressed air in accordance with an aspect of the present invention.

FIG. 8 illustrates the caliper (mil) of tissue papers prepared with dissolved air according to method 200 (FIG. 2) (fiber slurry sat. with 30 psi air, dotted fill) compared to control tissue papers (solid fill) without dissolved air. Caliper relates to the thickness of the tissue paper. An increased caliper correlates with increased bulk and softness. As shown, tissue papers prepared with dissolved air have an increased caliper, compared to control tissue papers.

Figure 9:
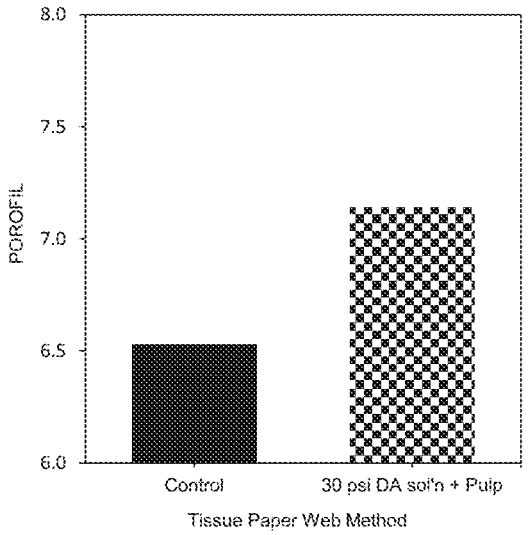
FIG. 9 is a graph of tissue paper void volume (POROFIL) in papers prepared with and without compressed air in accordance with an aspect of the present invention.

FIG. 9 illustrates POROFIL, or void volume, of tissue papers prepared with dissolved air according to method 200 (FIG. 2) (fiber slurry sat. with 30 psi air, checkered fill) compared to control tissue papers without dissolved air (solid fill). An increased void volume correlates with a bulker, more porous tissue paper. As indicated, tissue papers prepared with dissolved air have increased void volume compared to controls.

Examples 5-6

In Examples 5-6, tissue papers were prepared with secondary, recycled fibers. The tissue sheets were formed on a forming wire using the laboratory through air drying simulation procedure. Then the sheets were dried on the forming wire under a vacuum.

In Example 5, control tissue sheets were prepared as described above for Example 1. The control sheets were prepared using TAD simulation without the addition of air. Tissue sheets in Example 6 were prepared using the fiber slurry supersaturated with air at 30 PSI, as in Example 4.

Table 2 provides the basis weight, caliper, CD and MD tensile strength, CD and MD stretch, CD and MD TEA, Porofil (void volume), and air flow of the tissue sheets prepared in Examples 5 (control) and 6 (30 PSI). As shown, tissue sheets prepared with dissolved air had decreased tensile strength and increased caliper, compared to control tissue sheets. Further, the increased porofil (void volume) and air flow, compared to the control tissue sheets, indicated that the dissolved air provided a bulkier, more porous tissue sheet.

TABLE 2

| Description | CD Tensile strength (g/3 in) | CD Stretch (%) | CD TEA (mm-gm/mm$^2$) | MD Tensile (g/3 in) | MD Stretch (%) | MD TEA (mm-gm/mm$^2$) | Basis Weight (lb./3,000 ft$^2$) | Caliper (mils/sheet) | POROFIL | Air Flow CFM @ 16" |
|---|---|---|---|---|---|---|---|---|---|---|
| Control | 1.814 | 5.25 | 0.74 | 1.884 | 3.61 | 0.58 | 30.86 | 16.33 | 6.53 | 606.0 |
| 30 PSI | 1.648 | 2.015.33 | 0.68 | 1.564 | 3.53 | 0.47 | 30.62 | 16.83 | 7.14 | 697.1 |

FIGS. 12 and 13 illustrate air flow/permeability curves for Examples 5 and 6. Tables 3 and 4 below show the data points for control sheets and 30 PSI sheets, respectively.

FIG. 12 shows delta pressure (Dp) (inches water column (inches W.C.)) as a function of air flow (CFM/min/ft$^2$). The curve with diamond data points are the control sheets, and the curve with circle data points are the 30 PSI sheets. The 30 PSI sheets have an increased air flow at a given delta pressure compared to the control sheets.

FIG. 13 shows the relationship between velocity/pressure (V/P) and $1/P^{0.5}$ in the inertial regime at higher differential pressures (in this plot 8 in of WC and higher). The curve with diamond data points are the control sheets, and the curve with circle data points are the 30 PSI sheets. The slope of the 30 PSI line was 24% higher than the control line as a direct result of the more open pore structure. This more open pore structure indicated less bonding of the sheet and was consistent with lower drying energy, higher bulk caliper, higher porofil, lower tensile, and higher potential softness.

TABLE 3

| Dp inches W.C. | V - Air Flow ft$^3$/min/ft$^2$ | V/P | $P^{-0.5}$ |
|---|---|---|---|
| 0.1 | 6.9 | 69.4 | 3.162 |
| 0.2 | 14.0 | 70.0 | 2.236 |
| 0.4 | 26.6 | 66.5 | 1.581 |
| 0.5 | 33.6 | 67.2 | 1.414 |
| 1.0 | 78.2 | 78.2 | 1.000 |
| 2.0 | 127.0 | 63.5 | 0.707 |
| 4.0 | 219.0 | 54.8 | 0.500 |
| 6.0 | 305.0 | 50.8 | 0.408 |
| 8.0 | 363.0 | 45.4 | 0.354 |
| 10.0 | 430.0 | 43.0 | 0.316 |
| 12.0 | 492.0 | 41.0 | 0.289 |
| 14.0 | 550.0 | 39.3 | 0.267 |
| 16.0 | 606.0 | 37.9 | 0.250 |
| 18.0 | 665.6 | 37.0 | 0.236 |
| 20.0 | 711.2 | 35.6 | 0.224 |

TABLE 4

| Dp inches W.C. | V - Air Flow ft$^3$/min/ft$^2$ | V/P | $P^{-0.5}$ | % V Increase |
|---|---|---|---|---|
| 0.1 | 9.09 | 90.9 | 3.162 | 31% |
| 0.2 | 17.8 | 89.0 | 2.236 | 27% |

TABLE 4-continued

| Dp inches W.C. | V - Air Flow $ft^3/min/ft^2$ | V/P | $P^{-0.5}$ | % V Increase |
|---|---|---|---|---|
| 0.4 | 33.6 | 84.0 | 1.581 | 26% |
| 0.5 | 42.1 | 84.2 | 1.414 | 25% |
| 2 | 150 | 75.0 | 0.707 | 92% |
| 4 | 263 | 65.8 | 0.500 | 107% |
| 6 | 340 | 56.7 | 0.408 | 55% |
| 8 | 421 | 52.6 | 0.354 | 38% |
| 10 | 498 | 49.8 | 0.316 | 37% |
| 12 | 570 | 47.5 | 0.289 | 33% |
| 14 | 632 | 45.1 | 0.267 | 28% |
| 16 | 697.1 | 43.6 | 0.250 | 27% |
| 18 | 754 | 41.9 | 0.236 | 24% |
| 20 | 813.5 | 40.7 | 0.224 | 22% |

With respect to the above description, itis to be realized that the optimum proportional relationships for the parts of the invention, to include variations in components, concentration, shape, form, function, and manner of manufacture, and use, are deemed readily apparent and obvious to one skilled in the art, and all equivalent relationships to those illustrated in the specification are intended to be encompassed by the present invention.

Therefore, the foregoing is considered as illustrative only of the principles of the invention. Further, various modifications may be made of the invention without departing from the scope thereof, and it is desired, therefore, that only such limitations shall be placed thereon as are imposed by the prior art and which are set forth in the appended claims.

What is claimed is:

1. A gas-impregnated tissue paper substantially free of a chemical debonder and having a percent increase in slope of velocity/pressure (($feet^3/min/feet^2$)/inches water column) as a function of $1/P^{0.5}$ of at least 15% compared to a like non-gas-impregnated tissue paper; wherein P is pressure from about 8 inches water column to about 20 inches water column.

2. The gas-impregnated tissue paper of claim 1, wherein the increase in slope of velocity/pressure is at least 20% compared to a like non-gas-impregnated tissue paper.

3. The gas-impregnated tissue paper of claim 1, wherein the increase in slope of velocity/pressure is at least 22% compared to a like non-gas-impregnated tissue paper.

* * * * *